US005647286A

United States Patent [19]

Dunn

[11] Patent Number: 5,647,286

[45] Date of Patent: Jul. 15, 1997

[54] EXTENSION FOR FURNITURE LEGS

[76] Inventor: Gary Dunn, 2368 Podocarpus Way, Clearwater, Fla. 34619

[21] Appl. No.: 429,151

[22] Filed: Apr. 26, 1995

[51] Int. Cl.[6] ..... A47B 9/00

[52] U.S. Cl. ..... 108/144; 248/188.2

[58] Field of Search ..... 248/188.2, 188.5, 248/189.9, 188.8; 108/144; 297/440.11; 312/351.3

[56] References Cited

U.S. PATENT DOCUMENTS

| | | | |
|---|---|---|---|
| 3,088,785 | 5/1963 | Schuette | 248/188.2 |
| 3,190,688 | 6/1965 | Westrum et al. | 248/188.5 |
| 3,503,390 | 3/1970 | Peters | 248/188.5 |
| 5,352,168 | 10/1994 | Wilkinson | 248/188.2 |

*Primary Examiner*—Peter M. Cuomo
*Assistant Examiner*—Gerald A. Anderson
*Attorney, Agent, or Firm*—Terrance L. Siemens

[57] ABSTRACT

An extension for a table or other furniture having a tubular leg. The extension has two cylindrical sections of lesser and greater diameter. The cylindrical section of lesser diameter penetrates into the tubular leg. The other cylindrical section is of diameter equal to that of the leg. Thus, the other section maintains the aesthetic effect of the leg, and also serves as a stop preventing excessive downward travel or migration of the leg onto the extension. In addition, a cap terminating the leg fits equally well onto the extension. Preferably, the extension is tubular, so that several extensions can be assembled onto the leg in stacked fashion if desired. In an alternative embodiment, the extension has a series of holes and a pin insertable into the holes, so that fine adjustment of the height of the furniture may be made.

5 Claims, 2 Drawing Sheets

EXTENSION FOR FURNITURE LEGS

BACKGROUND OF THE INVENTION

1. Field of the Invention

The present invention relates to a member for extending the length of a table leg. The member is configured similarly to and compatible with the table leg, having stepped, cylindrical construction, and is joined telescopically with the table leg when in use.

2. Description of the Prior Art

Collapsible tables built for general purposes of display and storage are commonly available from commercial sources. These tables are not designed for any specific task, but rather in anticipation that they will be employed primarily in offices and public functions. Such tables are typically designed such that their work surfaces are about twenty nine inches (75 cm) above the floor surface on which the table has been erected.

This height is suitable for many purposes, but is inadequate for others. If the table is employed for assembly, or any demanding task requiring manipulation of a workpiece, it becomes far more critical that the working surface be at a more comfortable working height. This allows a worker to maintain output, resist fatigue due to an awkward working position, and generally avoid discomfort.

The advantages of a table of adjustable height are illustrated in U.S. Pat. No. 761,468, issued to Harriet F. Ford on May 31, 1904.

Other prior art designs of adjustable legs for tables and other furniture are seen in U.S. Pat. Nos. 706,377, issued to James Barbee on Aug. 5, 1902, 719,146, issued to William A. Schofield et al. on Jan. 27, 1902, 2,599,020, issued to Alden L. Safstrom on Jun. 3, 1952, 3,043,641, issued to DeWitt W. Hanmore on Jul. 10, 1962, and 3,183,861, issued to Robert T. Halstrick on May 18, 1965. Telescoping, variably extensible furniture legs are shown in these patents. The legs are typically secured at a desired height by insertion of a locking pin.

These devices are generally dependent upon being designed integrally with the associated furniture. They have little provision for being installed in furniture not specially designed for use therewith.

None of the above inventions and patents, taken either singly or in combination, is seen to describe the instant invention as claimed.

SUMMARY OF THE INVENTION

The present invention provides a modular leg extension which is specifically designed for retrofitting to furniture having tubular legs capped by a rubber or plastic cap. The extension is designed to rely upon only limited cooperation with the preexisting furniture, that being cooperation with inner and outer dimensions of the tubular legs.

The novel extension fits telescopically within the hollow tubular leg of the furniture. The extension has a shoulder of external diameter equal to that of the leg. The shoulder provides an interfering member arresting downward migration of the tubular leg over the extension which fits thereinto. The interfering stop assures effectiveness while remaining independent of moving parts, such as set screws.

The shoulder further improves the aesthetics of the assembly by maintaining a single outer diameter, and also enables the preexisting rubber or plastic cap to be relocated at the bottom of the extension. This is a useful feature, since the advantages of the cap are retained, while no new part is required.

In an alternative embodiment, the extension has an adjustment feature provided by a locking pin and a selection of holes into which the pin may be inserted.

Accordingly, it is a principal object of the invention to provide an extension compatible with the legs of an item of furniture.

It is another object of the invention that the extension be aesthetically pleasing.

It is a further object of the invention to reuse an existing leg cap.

It is an additional object of the invention to enable adjustment of the height of the item of furniture.

It is again an object of the invention to provide a stop which arrests downward migration of the leg with respect to the extension.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
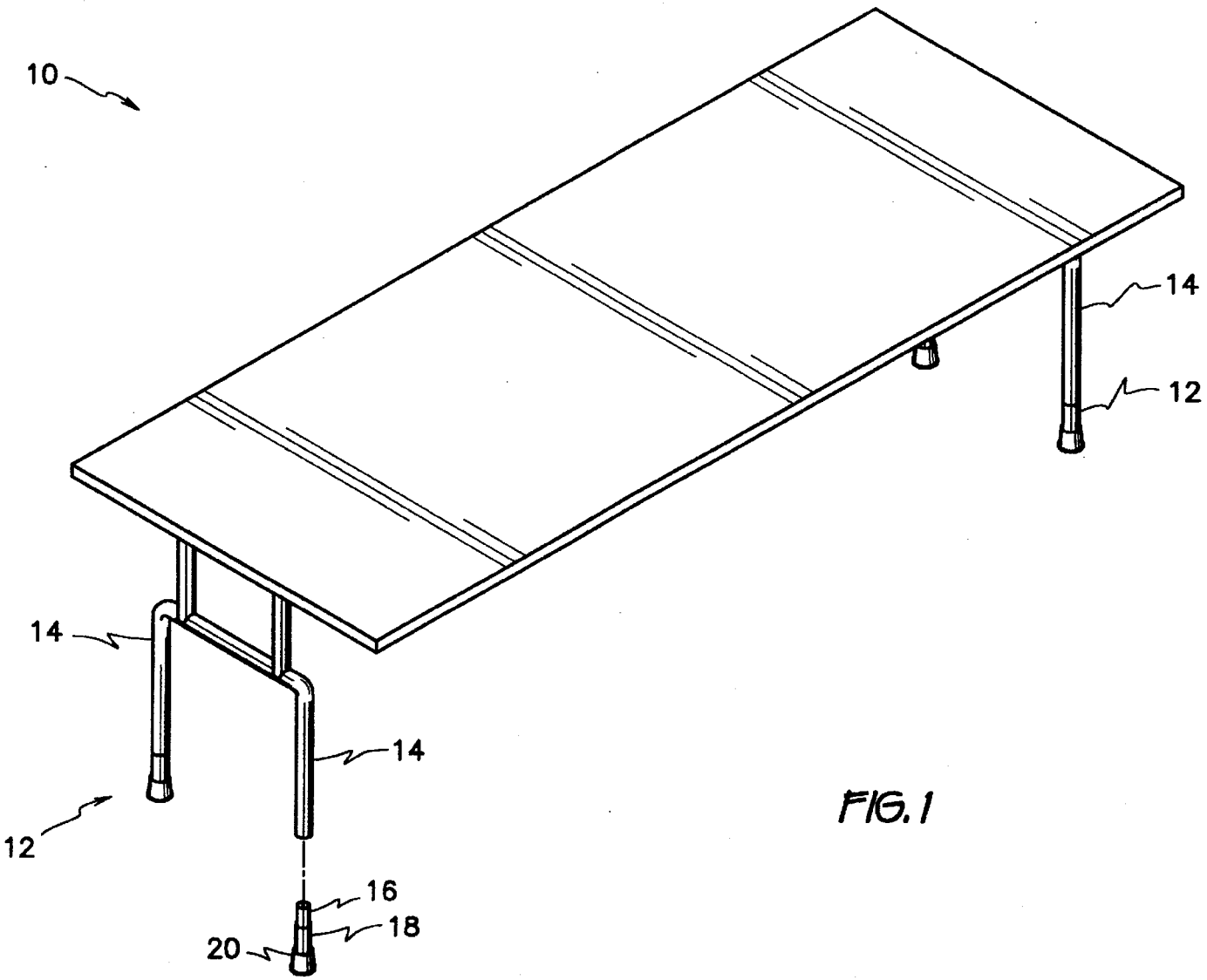
FIG. 1 is a perspective, partially exploded view of a plurality of inventive extensions shown with an associated table.

FIG. 1 shows an item of furniture, represented by table 10, adapted to include a plurality of leg extensions 12. Legs 14 of table 10 are tubular, having a constant outer diameter and an internal diameter. Leg 14 projects vertically below every other part of table 10.

Extension 12 is of stepped, hollow cylindrical construction, having a first upper section 16 of diameter slightly less than the internal diameter of leg 14, so that extension 12 penetrates into leg 14. Preferably, this is a close fit generating a degree of friction, so that there is little play if any between extension 12 and leg 14. Also, should table 10 be lifted, extension 12 will not fall out of engagement with leg 14.

A second lower, hollow cylindrical section 18 is joined to first upper, hollow section 16. Second lower section 18 has a diameter greater than that of first upper section 16, and preferably identical to that of leg 14. This arrangement assures that second lower section 18 serve as a stop arresting penetration of extension 12 into leg 14 by direct interference, and no separate part need be furnished to accomplish this purpose.

Preferably, second section 18 is tubular, and of identical internal diameter as that of leg 14, so that several extensions 12 may be assembled in stacked fashion.

Figure 2:
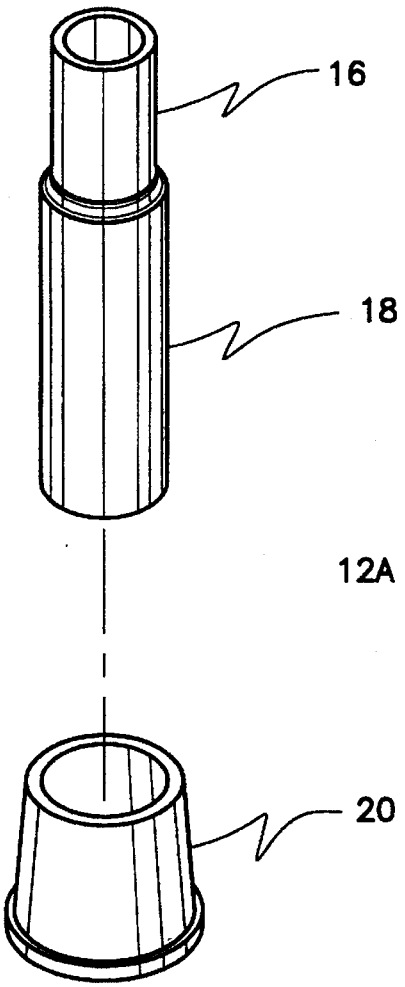
FIG. 2 is an exploded detail view of the extension, drawn to enlarged scale.

FIG. 2 illustrates the construction of extension 12 in greater detail. It will be seen that a cap 20 normally provided for sealing the otherwise open end of leg 14 and for protecting finished floor surfaces from scuffing and scratching can be frictionally fitted to second section 18 of extension 12. Thus, the same cap 20 terminating leg 14 and originally provided for table 10 is readily reused, and no additional cap need be provided.

Figure 3:
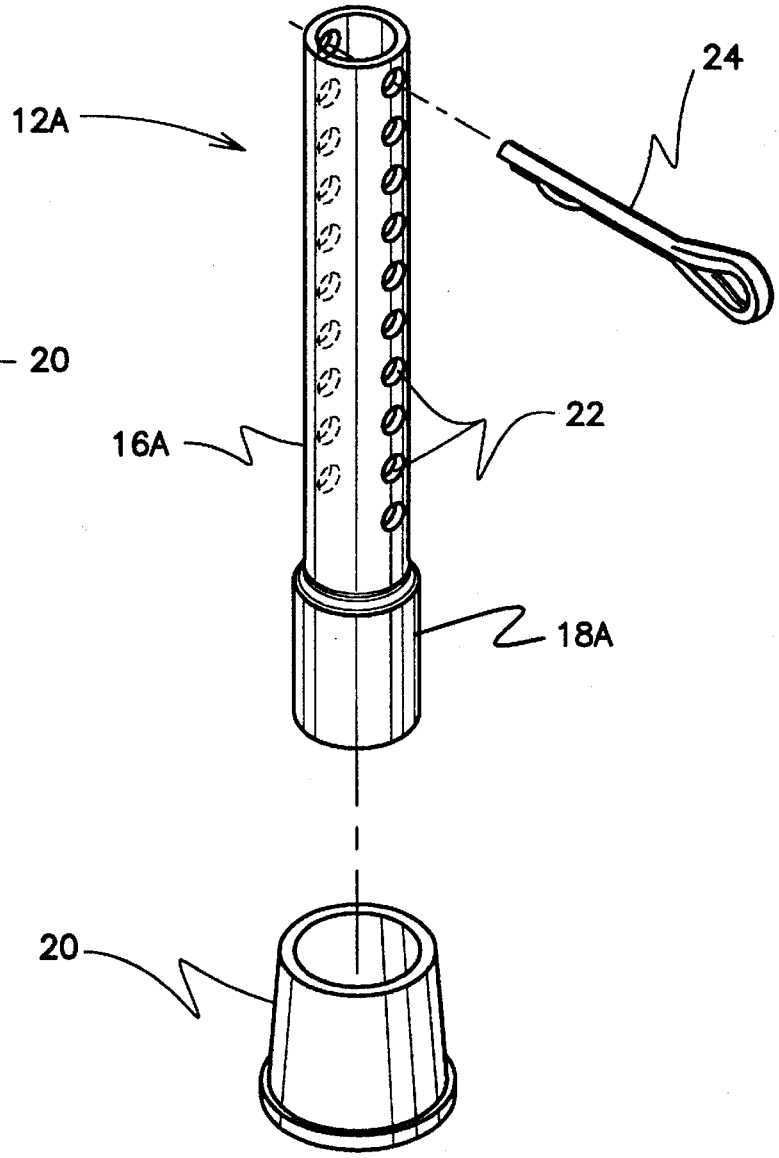
FIG. 3 is an exploded detail view of a second embodiment of the extension, illustrating height adjustment.

FIG. 3 shows an alternative embodiment of extension 12 which permits fine adjustment of the height of the working surface of table 10 from a supporting floor surface. First or upper section 16A of extension 12A has a series of holes 22 formed therein. Holes 22 are vertically offset from one another, and further are located above one another.

A pin 24 having an external diameter greater than the diameter of holes 22 is insertable into holes 22. When inserted, pin 24 provides an interfering surface attached to extension 12A. This interfering surface supports leg 14 and table 10, and stops extension 12 from penetrating into leg 14 to an unintended degree. Pin 24 provides a second or auxiliary stop in the sense of being in addition to the shoulder of lower second 18A of extension 12A, which shoulder would interfere with tubular leg 14 (see FIG. 1) in the absence of pin 24.

Preferably, all holes 22 are of identical internal diameter, so that one pin 24 fits identically therein.

The advantages accruing from locating holes 22 in vertical registry are twofold. One advantage is that first section 16 of extension 12 has a lateral wall which has a continuous vertical section thereof. This maintains the structural integrity of extension 12, with respect to the ability to support weight.

A second advantage is that moving pin 24 from one hole to another is more easily performed, pin 24 being held in constant horizontal orientation during this maneuver.

It will be seen that magnitude of the overal length of extension 12 (see FIG. 1) and extension 12A (see FIG. 3) is at least three times that of the overall diameter in both cases. Also, lower section 16 (see FIG. 1) is is greater in length dimension than in diameter dimension.

The novel extension 12 is easily installed on furniture, and selectively raises a working surface thereof to a desirable height. The complexity and cost are minimized, yet the strength is adequate for the purpose.

It is to be understood that the present invention is not limited to the embodiments described above, but encompasses any and all embodiments within the scope of the following claims.

I claim:

1. An item of furniture having:

at least one tubular leg having a first outer diameter and an internal diameter, said leg projecting below every other part of said item of furniture, said leg having bottom end portion which is surrounded by and frictionally fitted with a protective cap; and an extension removable from said leg, said extension having an upper section of hollow tubular configuration and having a second outer diameter of magnitude less than that of said internal diameter of said tubular leg, and a lower section joined to said upper section, said lower section being of hollow tubular configuration and having a third outer diameter of magnitude substantially equal to that of said first outer diameter; whereby upon removal of said protective cap from said leg, said upper section penetrates into said tubular leg, and said lower section serves as a stop arresting penetration of said extension into said tubular leg by interference with said tubular leg and further maintains a single outer diameter when said extension is assembled to said leg so that a lower portion of said lower section of said extension may be surrounded by and frictionally fitted with said protective cap.

2. The item of furniture according to claim 1 whereby a plurality of said extensions may be assembled together in stacked fashion.

3. The item of furniture according to claim 1, said first section of said extension further comprising means defining a plurality of holes therein, said holes vertically offset from one another, said holes having internal diameters of equal magnitude, and a pin for providing an interfering surface attached to said extension, said pin providing an auxiliary stop, whereby said tubular leg contacts said pin and is stopped thereby, said pin having an external diameter of magnitude less than that of said internal diameters of said holes, whereby said pin is insertable into said holes and supports said tubular leg thereon.

4. The item of furniture according to claim 1, said extension having an overall length dimension of magnitude at least three times as great as that of the diameter of said extension.

5. An item of furniture having:

at least one tubular leg having a first outer diameter, an internal diameter, said leg projecting below every other part of said item of furniture and having a bottom end portion, and a cap terminating and surrounding said tubular leg at said bottom end portion and frictionally fitting thereto;

an extension removable from said leg, said extension having a first section of hollow, cylindrical configuration and having a second outer diameter of magnitude less than that of said internal diameter of said tubular leg, and a second hollow, tubular section joined to said first section, said second section being of cylindrical configuration and having a third outer diameter of magnitude equal to that of said first outer diameter, whereby said first section penetrates into said tubular leg, and said second section serves as a stop arresting penetration of said extension into said tubular leg by interference therewith, and whereby a plurality of said extensions may be assembled together in stacked fashion and maintain a single outer diameter when said extensions are assembled to said leg; and said cap fitting frictionally to, selectively, said leg and to said second section of said extension, said first section of said extension further comprising means defining a plurality of holes therein, said holes vertically offset from one another, said holes having internal diameters of equal magnitude, and a pin for providing an interfering surface attached to said extension, whereby said tubular leg contacts said pin and is stopped thereby, said pin having an external diameter of magnitude less than that of said internal diameters of said holes, whereby said pin is insertable into said holes and supports said tubular leg thereon.

* * * * *